US006491534B1

(12) United States Patent
Bonard et al.

(10) Patent No.: US 6,491,534 B1
(45) Date of Patent: Dec. 10, 2002

(54) SAFETY SOCKET

(75) Inventors: Yves Bonard, Carouga (CH); Jean-Luc Damond, Crans-sur-celigny (CH); Philippe Moret, Nyon (CH)

(73) Assignee: Dolsimer Investment S.A. (PA)

( * ) Notice: Subject to any disclaimer, the term of this patent is extended or adjusted under 35 U.S.C. 154(b) by 0 days.

(21) Appl. No.: 09/980,558

(22) PCT Filed: Mar. 29, 2000

(86) PCT No.: PCT/CH00/00183

§ 371 (c)(1),
(2), (4) Date: Nov. 1, 2001

(87) PCT Pub. No.: WO00/67349

PCT Pub. Date: Nov. 9, 2000

(30) Foreign Application Priority Data

May 3, 1999 (EP) ..... 99810372
Jul. 27, 1999 (CH) ..... 1380/99

(51) Int. Cl.[7] ..... H01R 29/00
(52) U.S. Cl. ..... 439/188; 439/419; 439/666; 439/339
(58) Field of Search ..... 439/188, 419, 439/666, 667, 339

(56) References Cited

U.S. PATENT DOCUMENTS 656,284 A * 8/1900 Froschl ..... 439/666
4,456,322 A * 6/1984 Ferroni ..... 200/51.09
4,768,966 A * 9/1988 Doherty ..... 439/137
5,573,419 A * 11/1996 Chen ..... 439/340
6,322,380 B1 * 11/2001 Conroy ..... 439/188

FOREIGN PATENT DOCUMENTS

EP 0027244 A * 4/1981 ..... H01R/33/30
EP 0030128 A1 * 10/1981 ..... H01R/33/30
EP 0744792 A2 * 11/1996 ..... H01R/33/96
NL 7103222 A * 9/1971 ..... H01R/33/30

* cited by examiner

*Primary Examiner*—Gary Paumen
*Assistant Examiner*—James R. Harvey
(74) *Attorney, Agent, or Firm*—Harness, Dickey & Pierce, P.L.C.

(57) ABSTRACT

A socket for an electric light is provided including a first electric supply circuit, a second electric supply circuit, and a safety device adapted to detect presence or absence of a light bulb in the socket.

35 Claims, 6 Drawing Sheets

SAFETY SOCKET

BACKGROUND OF THE INVENTION

1. Technical Field

The present invention concerns a safety socket for a light bulb with either a screw cap or a bayonet cap.

2. Discussion

Many electrocution accidents occur when an electric socket provided to receive a light bulb is devoid of such light bulb while being connected to a powered supply line. As safety specifications stipulate that the voltage is applied to the central contact block of the socket, an accident may arise when a finger or a tool such as a screwdriver is inserted into a bulbless socket and makes contact with the central contact block.

In the relatively frequent case where the phase voltage is applied to the contact tube of the socket instead of to the central block as a consequence of an assembling of the socket or of the supply line by an unqualified person, an accident can very easily occur because this contact tube is relatively unprotected from the exterior since it is normally connected to the earthed, or neutral wire conductor.

Similarly, an electrocution accident can occur when a light bulb is broken in a socket and a portion of the electric circuit of the light bulb remains under voltage and is no longer protected by the glass of the light bulb. In this case, likewise, a contact with a finger or a tool can be dangerous.

There are sockets provided with a hand-operable switch allowing to cut off the supply circuit of the central contact block. Since in a general manner these switches are rotary switches, it is not possible for the user to know if the supply circuit of the central contact block is cut off of not. The switch of such a socket is rather intended to turn the light on or off rather than to operate as a safety device.

The application EP-A-0 744 792 discloses a socket provided with a safety disc that descends when the light bulb is inserted into the socket. The safety disc is provided with a traversing contact to ensure the connection between the contact at the bottom of the cap and a contact block having the phase voltage. This embodiment corresponds to the closest prior art of the invention which is introduced in the preamble of the independent claims. In this document, the safety disc is provided with another traversing contact for the passage of the earth line, this contact being made in connection with a flexible conductive blade pushing against the thread of the light bulb. This conductive blade represents a danger for the user because it is easy, when there is no bulb in the socket, to bend this blade with the fingers or with a tool and to make it alive, in particular in the case where the phase and neutral wire conductors have been inverted, The application EP-A-0 027 244 describes a socket provided with a safety device having a very complicated construction, thus being little reliable in use. As mentioned previously, a movable conductive blade is provided to ensure the connection to the neutral with the same drawback as that mentioned previously.

SUMMARY OF THE INVENTION

A first object of the invention is to propose a safety socket for a light bulb provided with a safety device allowing to avoid an accidental contact with any accessible conductive part of the socket.

A second object of the invention is to propose that the preceding safety socket is provided with a safety device able to operate whatever the manner in which said socket is connected to the supply fine.

Another object of the invention is to propose a safety socket provided with a safety device of simple design and reliable in use.

Another object of the invention is to propose a safety socket provided with a safety device with redundant safety.

Still another object of the invention is to propose that the safety socket is provided with a lockable safety device.

Furthermore, transition sockets are known that allow fitting a light bulb provided with a cap having a determined diameter into a socket having an equal or different diameter.

On this basis, another object of the invention is to propose a transition socket provided with one or another of the above-mentioned safety devices.

These objects have been achieved by a safety socket of which a first embodiment is described in claim 1 whereas a second embodiment is described in claim 2, particular embodiments or variants being described in the dependent claims.

Several embodiments and variants of a safety socket according to the present invention are described in detail below, this description further mentions other advantages of the invention, and should be considered with respect to the annexed drawings comprising the Figures in which:

DETAILED DESCRIPTION OF THE PREFERRED EMBODIMENTS

The sockets and devices mentioned above and shown in the Figures are only described and represented very schematically, mainly in order to make their functioning understood. Their assembly and execution details, principally the electrical connections between their various components, are not described in full detail since they are known to a man skilled in the art.

Figure 1:
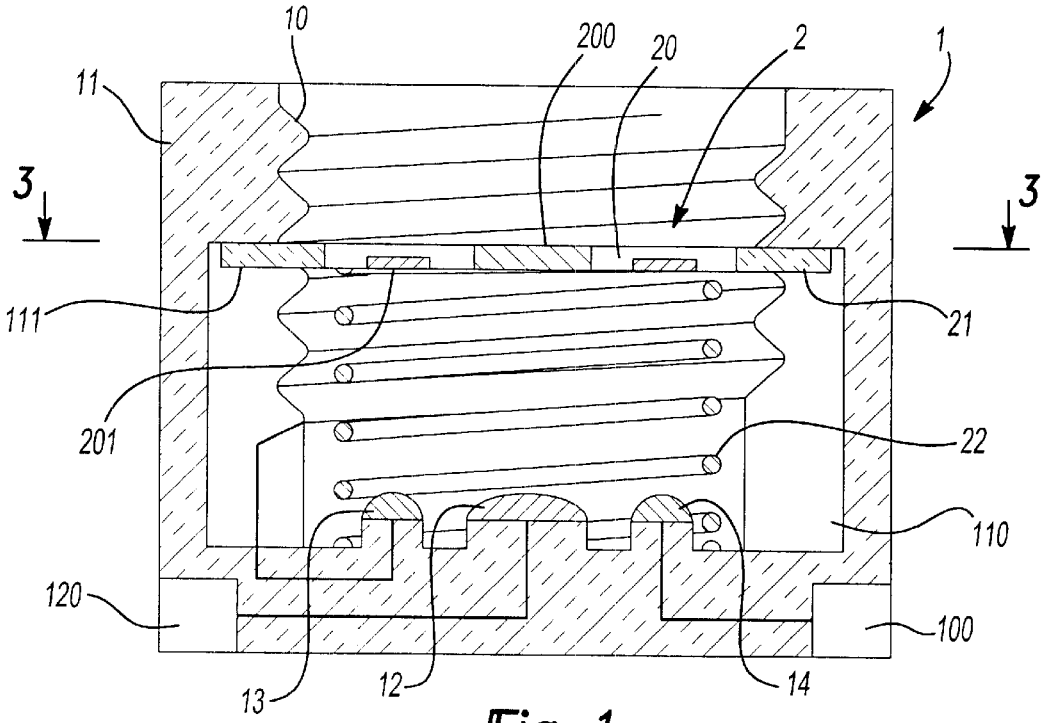
FIG. 1 shows schematically a section view of a part of a socket provided with a safety device according to a first embodiment of the invention in a disconnected state.

In a conventional manner, the socket 1 of FIG. 1, for a screw cap light bulb, comprises a threaded metallic tube 10, fitted into an insulating support 11 as well as a central contact block 12. A first terminal 100 receives the neutral wire conductor from the supply line of the socket (not represented) whereas a second terminal 120 receives the phase wire conductor. Generally, in the conventional sockets, terminal 120 is directly connected to central contact block 12 whereas terminal 100 is connected to metallic tube 10.

Figure 2:
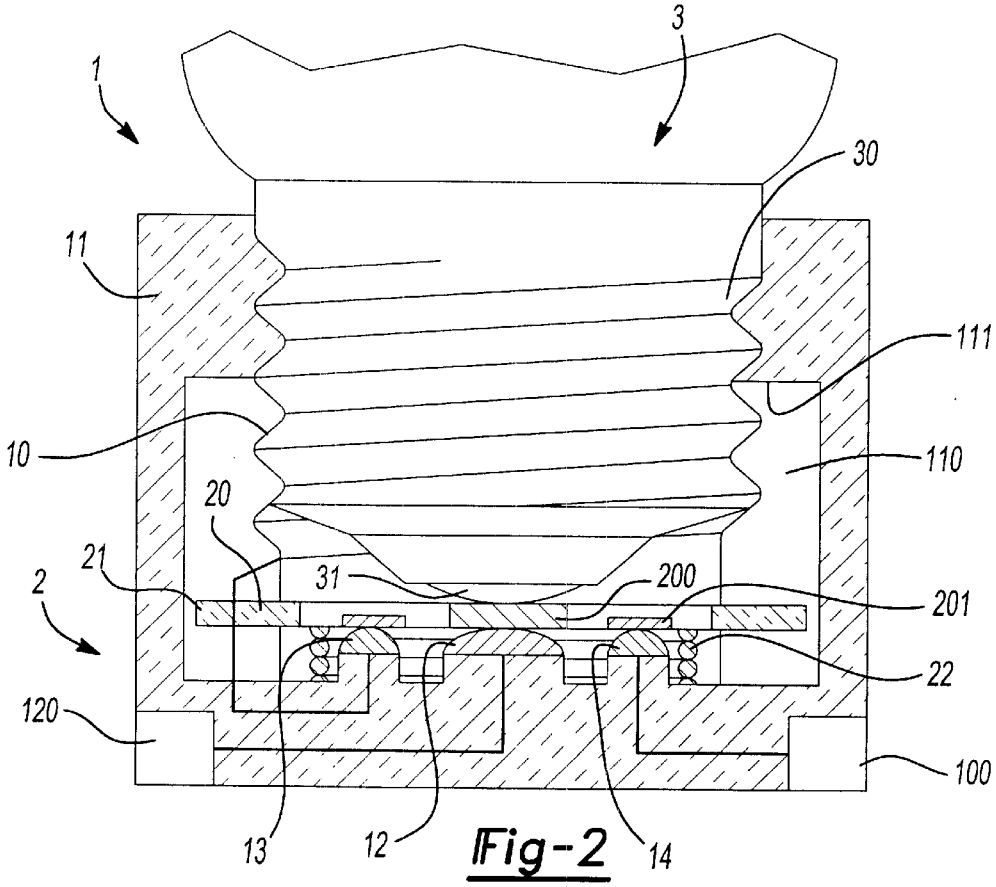
FIG. 2 shows schematically the same part of the socket in a connected state when a light bulb has been inserted into the socket.
Figure 3:
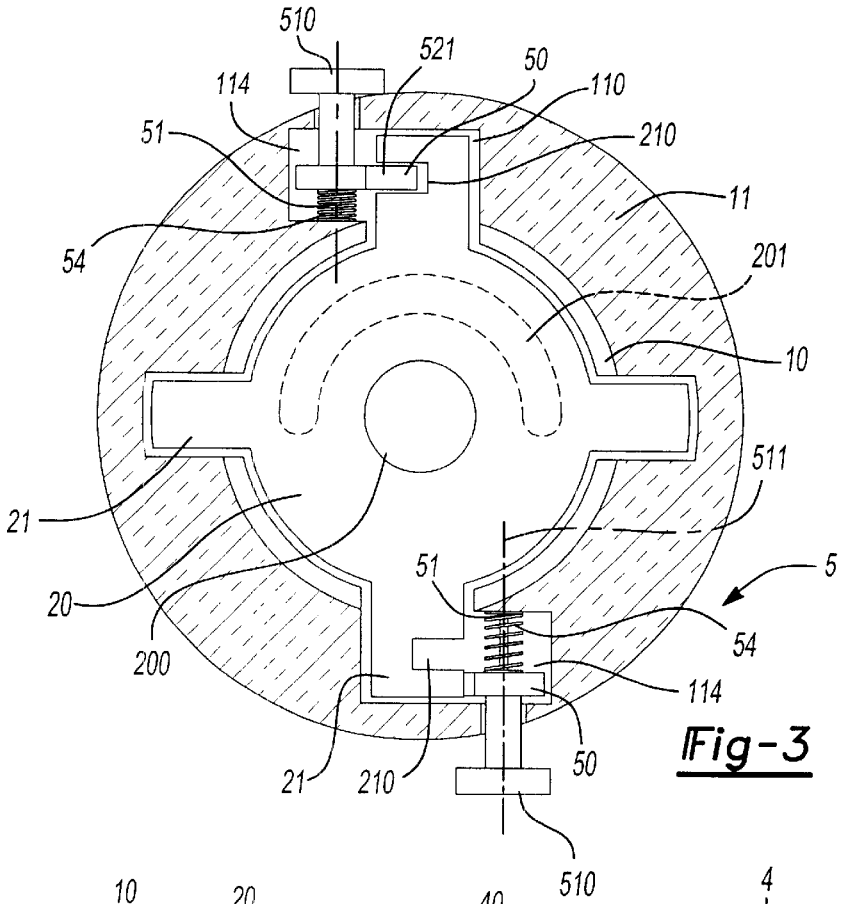
FIG. 3 shows schematically a section view along the line III—III of FIG. 1.

FIGS. 1, 2 and 3 show a screw-base socket 1 provided with a safety device 2 according to a first embodiment, consisting of an insulating safety disc 20. In this first variant, central contact block 12 is directly connected to terminal 120. The disc 20 is essentially made of an insulating material and is provided with a plurality of radial extensions 21, also insulating, each of said extensions 21 being seated in a recess 110 of insulating support 11 and/or of threaded tube 10. A spring means 22 is arranged between the bottom of socket 1 and disc 20, acting in a manner to separate disc 20 from, respectively, the bottom of the socket and the central contact block 12. Shoulders 111 limit recesses 110 towards the exterior of the socket, thus preventing disc 20 from leaving the socket. The insulating disc 20 comprises a contact capsule 200 disposed in the centre of disc 20 and passing through the disc in the direction of the longitudinal axis of the socket.

The disc 20 further comprises a conductive pathway 201 on its internal face, insulated with respect to capsule 200. A possible path of this conductive pathway 201 is visible in FIG. 3. The bottom of the socket comprises, further to central block 12 connected to terminal 120, two blocks 13 and 14 disposed on both sides of central block 12, facing portions of conductive pathway 201. The block 14 is connected to the neutral terminal 100, whereas block 13 is connected to threaded tube 10.

Thus, it may be understood that when there is no light bulb in the socket, as shown in FIG. 1, disc 20 is pushed away by spring 22, the extensions 21 being guided by the recesses 110 and abutting against shoulders 111, so as to close the bottom of the socket, i.e. to avoid that when a finger or a tool is inserted into the socket, that it enters directly into contact with central block 12 under voltage. In the same manner, the neutral circuit connecting the threaded tube and the terminal 100 is cut off, avoiding that a voltage appears on the portion of the threaded tube 10 easily accessible from the exterior of the socket in the case of an assembly inversion of the phase with the neutral.

The metallic parts easily accessible from the exterior of the socket 1, the conductive capsule 200 and the conductive tube 10 are thus fully galvanically insulated from the network.

By screwing a light bulb into the socket, as shown in FIG. 2, the cap bottom contact 31 of its cap 30 pushes disc 20 towards the bottom of the socket, until the contact capsule 200 contacts central block 12 and, simultaneously, the conductive pathway 201 contacts both contact blocks 13 and 14, Thus, the flow of current is established, from contact terminal 120 under voltage, towards contact block 12 and via the contact capsule 200 towards the cap bottom contact 31, the circuit closing it again to neutral potential from cap 30 towards threaded tube 10 connected to contact block 13, and further via conductive pathway 201 towards contact block 14, itself connected to contact block 100.

Variants are obviously possible for this first embodiment of the safety device. For example, in FIG. 3, disc 20 has been represented with four radial extensions 21 but it is obvious that it could include a different number. Preferably, disc 20 is provided with at least two radial extensions 21. Similarly, spring means 22 may be disposed in a different manner than represented here or replaced by any elastic means which have the same function as the one described. On the other hand, both blocks 13 and 14 may be disposed in any position at the bottom of the socket, the conductive pathway 201 having a form suitable for making contact between these two blocks.

Such a safety device according to the first embodiment as described above may also be adapted for a socket suitable for receiving a light bulb with a bayonet cap. In a general manner, two types of sockets for bayonet light bulbs are known: a first type generally used for an alternating voltage wherein there is a central contact block, similar to block 12 described above, and a smooth contact tube having electrically the same function as the threaded tube 10 described above, and a second type generally used for a continuous voltage comprising two contact blocks disposed side-by-side at the bottom of the socket. For the sockets of the first type (central block and contact tube), the construction and the functioning of the safety device are similar to that described above. For the sockets of the second type (two contact blocks side-by-side), the disc 20 will comprise two traversing contact capsules, each being able to put into contact one of the blocks with the corresponding cap bottom contact of the light bulb cap.

Figure 4:
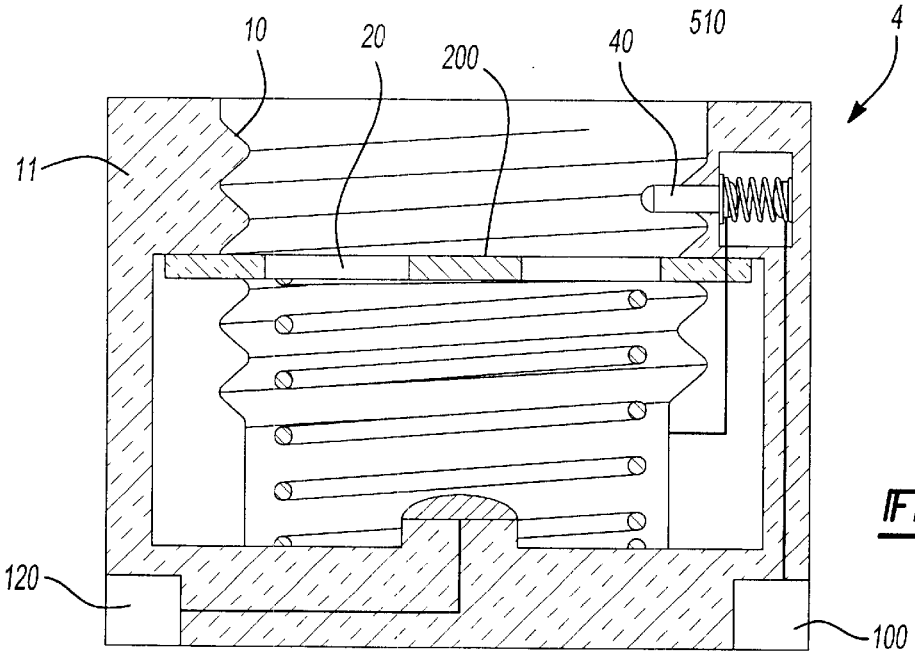
FIG. 4 shows schematically a section view of a part of a socket provided with a safety device according to a second embodiment of the invention in a disconnected state.
Figure 4A:
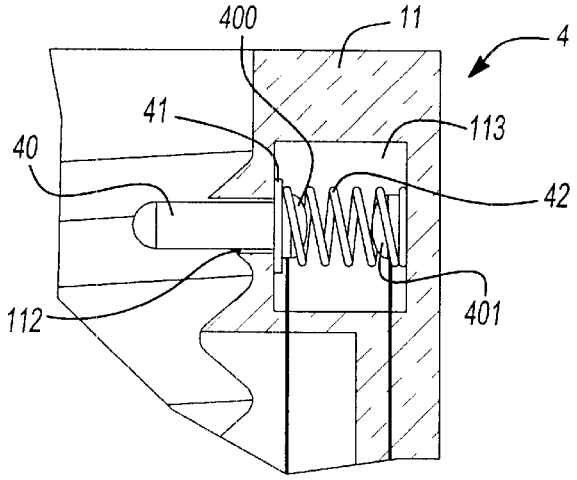
FIG. 4A shows a detail of the preceding Figure.
Figure 5:
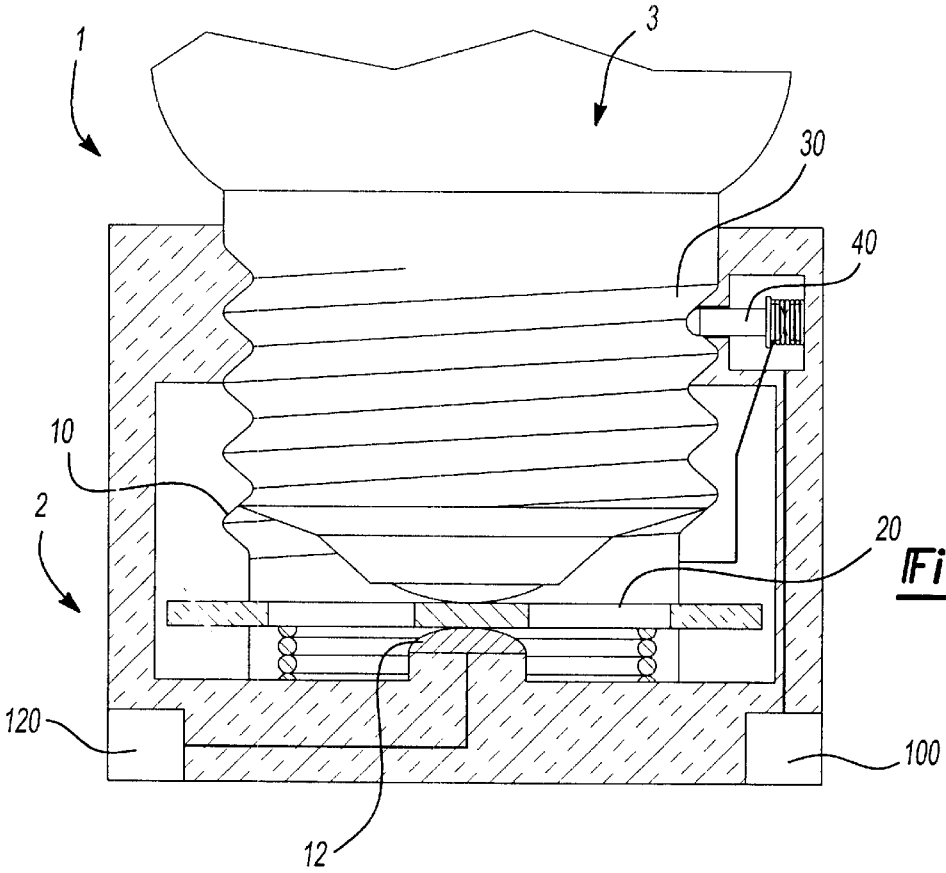
FIG. 5 shows schematically the same part of the socket in a connected state when a light bulb has been inserted into the socket.

A second embodiment of a safety device is shown in FIGS. 4, 4A and 5.

According to this embodiment, the electric connection between the threaded tube or wire conductor 10 and the contact terminal 100 is not disconnected by the movement of the disc 20, but by an independent auxiliary out-off means 4.

As shown in FIGS. 4, 4A and 5, this auxiliary cut-off means 4 consists of a lever or pushbutton 40 made of an insulating material, able to move radially in a boring 112 arranged in insulating support 11 and conductive tube 10. The boring 112 opens into a housing 113 arranged in insulating support 11. The back portion of the pushbutton 40 comprises a capsule or a contact element 400, a set collar 41 and an elastic means, for example a spring 42, able to push pushbutton 40 radially towards the interior of conductive tube 10. The displacement movement of pushbutton 40 is limited by the set collar 41. A second capsule or contact element 401 is disposed in housing 113, facing capsule 400. One of the two capsules, preferably capsule 401, is directly electrically connected to contact terminal 100, whereas the other capsule, preferably capsule 400, is directly electrically connected to conductive tube 10.

Thus, as one can be seen in FIG. 4A, when no light bulb is fitted in socket 1, spring 42 forces the pushbutton 40 towards the interior, thus separating the two capsules or contact elements 400 and 401 and disconnecting the electric circuit of the neutral which connected contact terminal 100 to conductive tube 10. The phase circuit is disconnected as previously described by the ascension of insulating disc 20.

As shown in the FIG. 5, when a light bulb 3 is fitted in the socket, the introduction of the cap in the tube 10 forces, on one hand, insulating disc 20 to connect the phase circuit, as described previously, and, on the other hand, forces push-button radially towards the exterior, thus establishing the electrical contact of the neutral circuit between the capsules or contact elements 400 and 401.

Figure 6:
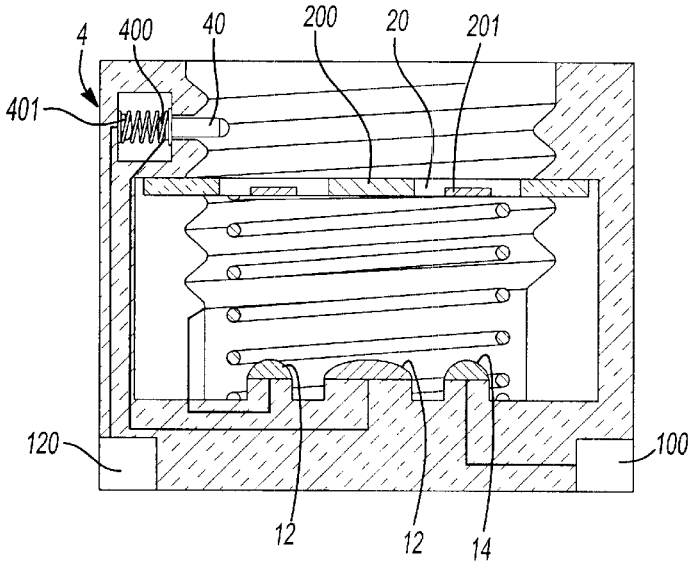
FIG. 6 shows schematically a section view of a part of a socket provided with a safety device according to another embodiment, in a disconnected state.

Thus, when the light bulb is introduced into the socket there is establishment of the phase circuit and of the neutral circuit, and, similarly, cut-off when the light bulb is removed, by two independent cut-off means, Another embodiment of the safety device is shown in FIG. 6.

This safety socket comprises the devices described previously, arranged in order to have a double cut-off, on both the phase circuit and the neutral circuit. Such an arrangement may be useful in some cases where the safety socket is used in a moist atmosphere or environment.

The socket is similar to that previously described with respect to FIGS. 1 to 3, although it further comprises an auxiliary cut-off device 4 as described with respect to FIGS. 4 and 5 with the difference that this auxiliary cut-off device is interposed between terminal 120 and contact block 12, Thus, there is a double cut-off of the phase circuit by the contact elements or capsules 400 and 401 as well as by the contact block 12 and the contact capsule 200 and a double out-off of the neutral circuit by block 13 and conductive pathway 201 as well as between the same conductive pathway and the contact block 14.

Figure 7:
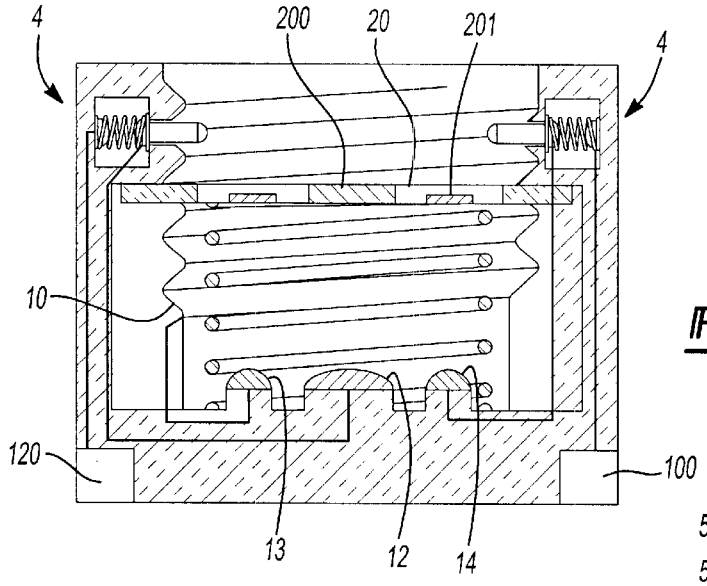
FIG. 7 shows schematically a section view of a part of a socket provided with a safety device according to still another embodiment, in a disconnected state.

FIG. 7 shows a further embodiment of a safety socket in which the phase circuit is made safe as previously described by a first auxiliary cut-off device 4 followed by disc 20, while a second auxiliary cut-off device 4 is interposed in the neutral circuit. Maximum safety is thus obtained, in particular in the case where disc 20 would have been forced or broken as well as where the socket would be operated in a moist atmosphere or environment.

Like for the first described embodiment of the safety device, the other mentioned embodiments may be adapted to bayonet sockets of one or another of the types described.

Other construction arrangements than those described above, may be envisaged for a safety device 4 used for a socket according to the proposed embodiments. For example, the spring means 42 may be arranged differently from what it is shown in the Figure, and may be replaced by any elastic device having an equivalent effect, or even the same connection and disconnection effect of two contact capsules may be obtained by a swinging lever, an extremity of which protrudes into the threaded tube, or even any insulated actuating device having an equivalent effect. On the other hand, conductive tube 10, threaded or smooth, may be replaced by an insulating tube having a light bulb fixing function, whereas the electric supply function may be obtained by a blade terminal or by any conductive portion disposed on said insulating tube and able to contact the cap of a light bulb introduced into the socket.

If a safety socket provided with a device according to one or another of the embodiments as presented already offers a first level of safety by preventing an accidental contact with a conductive portion under tension of the socket, an additional locking device of the disc 20 in a position remote from the central block 12 may be suitable in order to prevent the disc 20 from moving by pushing it with a finger or a tool, without a light bulb being introduced in the socket.

Figure 8:
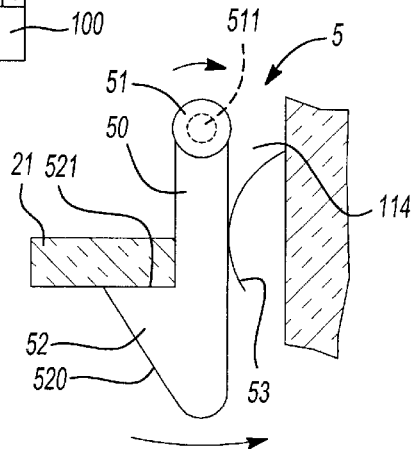
FIG. 8 shows schematically a first version of a locking device of a safety device for a socket.

A first version of a locking device 5 is schematically represented in a plan view in FIG. 3 and in an elevation view in FIG. 8. The locking device 5 consists here of a lever 50 mounted on a pivot 51 able to rotate around an axis 511 perpendicular to the longitudinal axis of the socket, as well as to slide along said axis 511. The lever 50 comprises a shoulder 52 comprising an inclined plane 520 and a flat part 621 as well as a pushbutton 510 protruding from the external wall of the socket. The device is further provided with a first elastic means, for example a spring 53, schematised here by a spring blade, able to maintain lever 50 in a locking position parallel to the longitudinal axis of the socket, as well as by a second elastic means, for example a spring 54, able to radially force back, respectively, the lever and pushbutton 510, towards the exterior. The lever 50 is able to rotate at a determined angle around axis 511 and to slide at a determined value into a housing 114 provided for this purpose in insulating support 11. The radial extension 21 closest to the locking device 5 comprises an indentation 210, turned towards the locking device and having a width slightly larger than the thickness of the lever 50.

When a bulb is fitted into the socket and then is removed there from by unscrewing it, disc 20 accompanies the withdrawing movement of the light bulb cap, being pushed by the spring 22 shown in the FIG. 1. During this movement, the radial extension 21 contacts the inclined plane 520 and pivots lever 50 in the direction indicated by the arrows in FIG. 8. When the radial extensions 21 of the disc 20 abut against the shoulders 111, lever 50 returns to the initial position under the action of the spring blade 53, the flat part 521 preventing then a new displacement of disc 20 towards the bottom of the socket while retaining the extreme portion of radial extension 21, as can be seen in a plan view on the lower part of FIG. 3. The disc 20 is thus locked in a position such that a contact with the central contact block 12 is impossible. In order to allow to fit a new light bulb into the socket, it is necessary to release disc 20. To this purpose, it is enough to push on the pushbutton 510, so that lever 50 is pushed towards indentation 210, as can be seen in the upper part of FIG. 3. Thus, the disc 20 is released and may drop towards the bottom of the socket during the introduction of the light bulb in order to respectively allow central block 12 to contact the bottom of the light bulb cap, and the block 13 and 14 the conductive pathway 201. Preferably, two locking devices 5 will be provided, each operating on one radial extension, preferably opposed relatively to the longitudinal axis of the socket. In this manner, disc 20 is maintained by two opposed extensions, thus preventing to bias it, the releasing of disc 20 then requiring to act in opposition in two opposed points of the socket.

Figure 9:
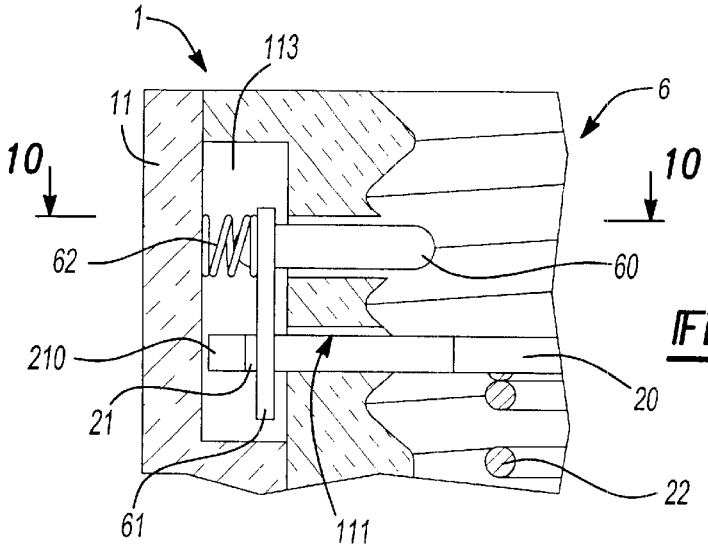
FIG. 9 shows schematically, according to an elevation partial section view, a second version of a locking device of a safety device for a socket.
Figure 10:
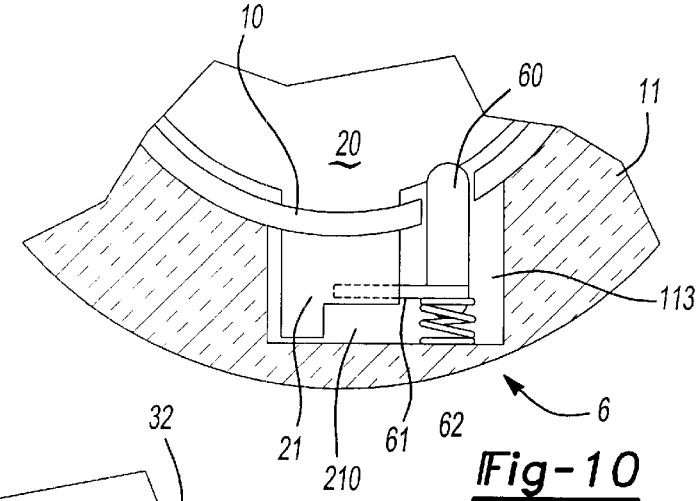
FIG. 10 is a plan partial section view along the line X—X of the preceding Figure.

According to a second version of a looking device as one can see in FIGS. 9 and 10, the locking device functions in a manner rather similar to the one which has just been described above, the difference being that the releasing proceeds automatically during the introduction of the light bulb into the socket. For this, device 6 is provided with a pushbutton 60 similar to pushbutton 40 described previously with respect to FIG. 4, the extremity of the pushbutton 60 being disposed into the recess 113 carrying a lever 61 provided with a flat stop part, as the lever 50 seen above,. In this case, the movement of lever 61 needed for releasing the disc 20 is made radially towards the exterior.

By introducing a light bulb into the socket, the cap pushes pushbutton 60 towards the exterior, in opposition to the elastic means represented by spring 62, as described above with respect to FIGS. 4 and 5. The lever 61 is then moved towards the free extremity of extension 21 or the indentation 210 provided therein, in order to release extension 21 retained by the flat part, respectively to allow the disc 20 to move towards the bottom of the socket. When the light bulb is withdrawn, the disc is pushed by spring 22 until the extensions 21 abut against shoulder 111, the complete withdrawal of the light bulb releasing pushbutton 60 which, under the effect of spring 62, blocks extension 21 under the flat part of the lever 61. According to this last version, the locking means 6 are automatically actuated during the introduction or the withdrawal of a bulb and accordingly do not require any handling for their operation.

It is obvious that the edges of the elements of the locking device in operating contact are formed, for example bevelled or rounded, in order to facilitate the sliding of these elements between them, for example the edge of radial extension 21 in contact with the lever 50 or 61 according to one or another of the versions described.

Other versions or variants of the locking device may be considered. For example, the upper portions of the guiding recesses 113 may each comprise an additional recess, disposed on a portion of the periphery of the socket, perpendicularly to the corresponding guiding recess, the disc 20 further comprising at least an operating lever, for example a radial projection of an extension 21 accessible from the exterior of the socket, said lever allowing, when the disc is in an abutment position in the upper portion of the guiding recesses, to rotate it a part of a revolution in order to engage the projections with the additional recesses so as to lock the disc, to rotate it in the inverse direction allowing to release it. Said lever may be operated manually or with the aid of a tool. Similarly in a variant of the pushbutton 60 of FIGS. 9 and 10, it is possible to have, for example, a pivoting lever, controlling lever 61, and where an extremity of which would protrude in the threaded conductive tube 10 or any other insulated actuating means.

It is obvious that the versions of the locking means of the disc 20 described above may also be adapted to a disc 20 provided within a bayonet socket according to one or another of the types as mentioned above.

We have seen that the safety device 4 comprises, as described above, a pushbutton 40 protruding in the conductive tube 10 and has a construction rather similar to the locking device which has been just described. Accordingly, one can advantageously rearrange these two devices in a common device, the actuation of the pushbutton by the introduction of a light bulb cap ensuring on the one hand an electric contact and releasing on the other hand the insulating disc 20.

Figure 11:
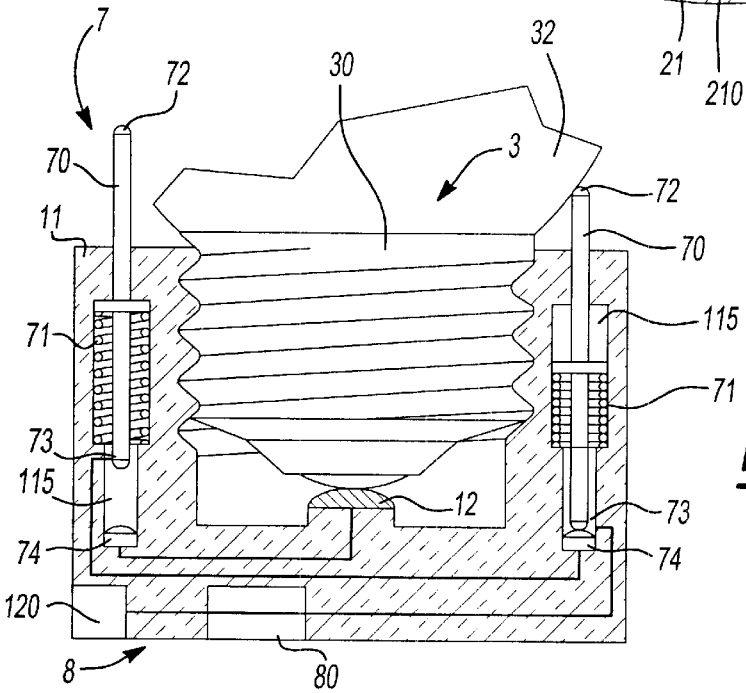
FIG. 11 shows schematically a socket provided with a safety device according to still another embodiment of the invention.

FIG. 11 shows another safety device 7 provided to detect the presence or the absence of a light bulb 3 in the socket. In this case, instead of detecting the presence or the absence of the cap 30 in the threaded tube as described until now, the device 7 detects the presence or the absence of the glass 32 of the light bulb 3. This safety device is particularly useful in order to prevent that a portion of the light bulb 3 remains under voltage when the glass is broken, in particular by vandalism.

The safety device 7 consists here of at least a rover or a pushbutton 70 that is capable of detecting, under the action of an elastic means, for example a spring 71, the presence or the absence of the glass 32. In the embodiment represented in the Figure, pushbutton 70 is housed in a recess 115 of insulating support 11 and is able to slide parallel to the longitudinal axis of the socket. The spring 71 respectively pushes the pushbutton 70 towards the exterior, and in the direction of the glass 32 in order that a first extremity 72 of the pushbutton may contact the glass 32. The other extremity of the pushbutton 70 is provided with a contact means 73 able to establish an electric connection with a second contact means 74.

In FIG. 4, one can see that the extremity 72 of the pushbutton 70 drawn in the left part does not detect the presence of a glass 32, causing the pushbutton to be fully forced back towards the exterior under the action of spring 71, thus cutting off the electrical connection between the contact means 73 and 74, while the extremity 72 of the pushbutton drawn in the right part detects the presence of a glass 32, causing the pushbutton to be forced back towards the exterior thus establishing the electrical connection between the contact means 73 and 74.

When the glass 32 is broken, glass fragments can stay fixed to the cap 30, so that it may be advantageous to arrange several safety devices 7 that are able to detect the presence of the glass 32 on the periphery of the socket so that in the case of broken glass, at least one pushbutton 70 is actuated for cutting off the electric supply circuit. In this case, it is advantageous that the contact means 73 and 74 of each of the pushbuttons is mounted in series, as represented in the Figure.

As previously, variants of embodiments may be considered, in particular the replacement of the pushbuttons 70 by swinging levers or other actuating devices having a similar effect, FIG. 11 still shows another safety device 8, independent from the previous one, consisting of a micro-fuse 80 mounted on the circuit connecting the phase terminal 120 and the central contact block 12. The micro-fuse 80 may be exchanged from outside the socket.

The safety device 7 for the detection of the glass 32 may be used alone, but preferably in combination with one or another of the safety devices previously described. The safety device 8 with microfuse 80 is usually used in combination with one or another of the safety device previously described.

A safety socket according to one or another of the embodiments or variants described has numerous applications. For example, it may be used as a socket mounted on a lamp intended for a child's bedroom. Several safety sockets may also be mounted in parallel, or in series in case of a direct current supply, in order to form a string of lights for an ornamentation or for the protection of a building site, for example. In this case, as these strings of light are rather vandalised, a subsequent electrocution may be thus avoided.

Figure 12:
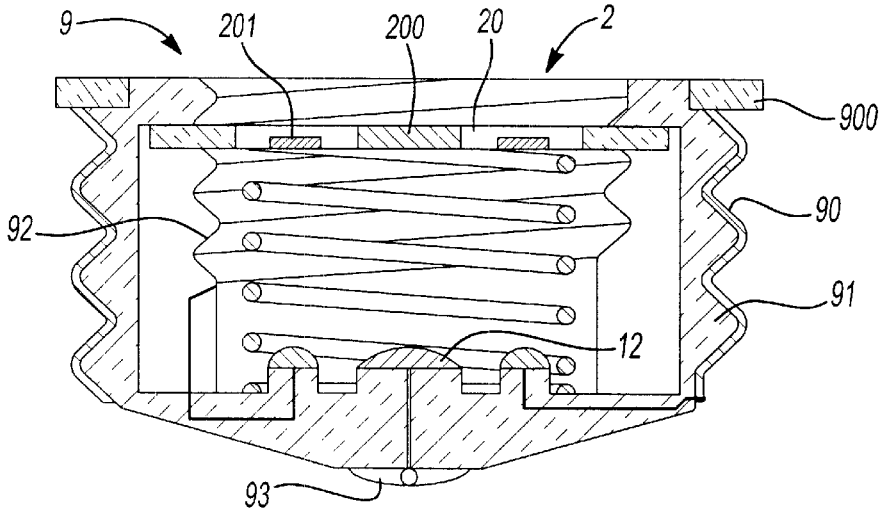
FIG. 12 shows schematically a transition socket provided with a safety device.

FIG. 12 shows a transition socket 9 comprising a first threaded conductive tube 90 within which an insulating body 91 and a second threaded conductive tube 92 are provided. In this type of transition socket, the light bulb whose cap diameter is adapted to the diameter of the second threaded tube 92 is screwed into this second threaded tube whereas the transition socket itself is screwed into a second socket adapted to the diameter of the first threaded tube 90. In the known transition sockets, the two threaded tubes 90 and 92 are directly electrically connected and the central contact block 12 is directly electrically connected to the cap bottom contact 93. Such a transition socket allows to fit a light bulb having a cap corresponding to the diameter of the second threaded tube 92 into a socket having a diameter corresponding to the one of the first threaded tube 90.

A safety device 2 corresponding to the first embodiment previously described, namely with a disc 20 provided with its contact capsule 200 as well as the conductive pathway 201, may for example be arranged on the transition safety socket 9 of FIG. 12, and operating exactly as described above. In this case, the phase contact terminal 120 is replaced by the cap bottom contact 93 whereas the neutral contact terminal 100 is replaced by the first threaded tube 90.

Figure 13:
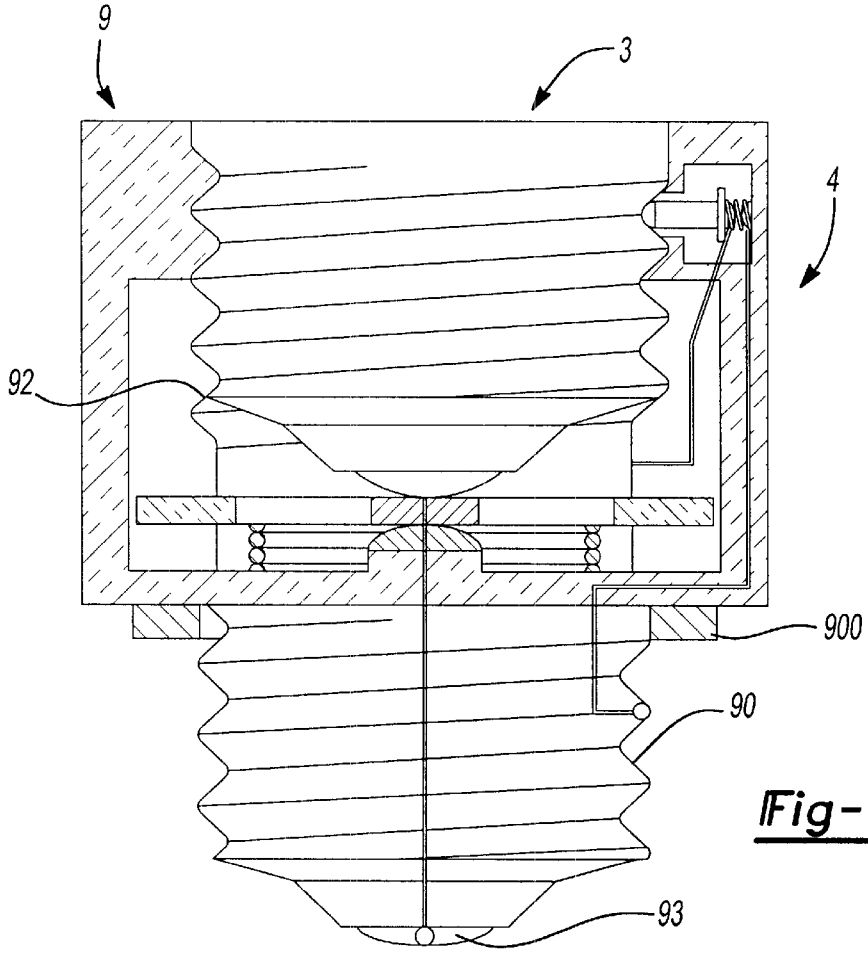
FIG. 13 shows schematically another transition socket also provided with a safety device.

The transition socket 9 of FIG. 13 is different from the one that has just been described insofar as the diameter of the first threaded tube 90 corresponds to the one of the second threaded tube 92. Such a transition socket would have no utility in itself, unless to be provided with a safety device according to one or another of the embodiments or variants previously described. Accordingly, such a transition socket allows to convert a conventional socket into a safety socket. In the case of FIG. 12, and as an example, the safety device is similar to the one described with respect to FIGS. 4 and 5, except that the contact terminal 120 is replaced by the cap bottom contact 93 whereas the neutral contact terminal 100 is replaced by the first threaded tube 90.

It should be understood here that a transition socket 9, of any type, either with or without variation of diameter, may be provided with one or several safety devices as previously described, according to one or another of the mentioned embodiments or variants for as safety device, Preferably, a transition socket 9 of any type will be provided with a technically known locking device schematically represented as 900 in FIGS. 12 and 13, so as to render this assembly non-dismountable or more difficult to dismount.

The man skilled in the art will know how to adapt the present description concerning the transition sockets provided with threaded caps to transition sockets provided with bayonet caps. The adaptation of this description to transition sockets allowing to pass from a threaded socket to a bayonet light cap or vice versa is also obvious.

The safety or transition sockets here described are particularly well adapted for installations operating under conventional normalized voltage, for example at 220 V, but they could also be used for installations operating under lower or higher voltage, as well as at all usual frequencies.

What is claimed is:

1. A socket for an electric light bulb comprising:

a first electric supply circuit supplying a phase voltage and including at least a first contact block provided at a bottom of the socket and a first contact piece;

a second electric supply circuit supplying a neutral voltage including at least a fixing tube having at least one conductive portion fitted into an insulating support and a second contact piece;

a safety device adapted to detect a presence or absence of a light bulb in said socket, the safety device including a disc made of an insulating material and provided with a plurality of radial extensions;

said disc being fitted into said socket so that the plan of said disc is essentially perpendicular to the longitudinal axis of the socket, said disc being adapted to slide along a direction of said longitudinal axis of the socket, being pushed by an elastic member to move away from the bottom of the socket, said radial extensions being adapted to slide into recesses provided within the socket in order to guide said disc, an abutment being provided in at least one recess to restrict the sliding of the disc towards the exterior of the socket; and said disc further including at least one conductive capsule traversing the disc and adapted to establish an electric contact between the first contact block and a cap bottom contact of the light bulb when the disc is pushed against the bottom of the socket by said light bulb fitted into the socket, wherein said disc further includes a conductive pathway insulated from the conductive capsule and provided on a face of said disc facing the bottom of the socket; and wherein said bottom of the socket further including two further contact blocks each provided opposite a portion of said conductive pathway, a first of said further contact blocks being electrically connected to the conductive portion of the support tube.

2. A socket according to claim 1, wherein the first contact block is electrically connected to the first contact piece.

3. A socket according to claim 1, further comprising:

an additional safety device including an insulated actuating device having a first extremity protruding in the interior of the socket and a second extremity provided within a recess of the insulating support and provided with a first contact capsule;

a second contact capsule being disposed in said recess opposite said first contact capsule;

an elastic member being provided to separate said contact capsules from each other;

the fitting of a cap of a light bulb into said socket actuating said insulated actuating device, thus putting into contact the two contact capsules, a first of said capsules being electrically connected to the first contact block whereas the second of said capsules is electrically connected to the first contact piece.

4. A socket according to claim 3, wherein the second of said further contact blocks is electrically connected to the second contact piece.

5. A socket according to claim 3, further comprising:

an additional safety device including an insulated actuating device having a first extremity protruding in the interior of the socket and a second extremity provided within a recess of the insulating support and provided with a first contact capsule;

a second contact capsule being disposed in the said recess opposite said first contact capsule;

an elastic member being provided to separate said contact capsules from each other;

the fitting of a cap of a light bulb into said socket actuating said insulated actuating device, thus putting into contact the two said contact capsules, a first of said capsules being electrically connected to the second one of said further contact blocks whereas the second of said capsules is electrically connected to the first contact piece.

6. A socket according to claim 1, further comprising at least one locking device adapted to lock said disc in a position remote from the bottom of the socket.

7. A socket according to claim 6, wherein the locking device includes a manual release.

8. A socket according to claim 7, wherein said locking device comprises a lever swivellingly mounted on a pivot essentially perpendicular to the longitudinal axis of the socket, said lever including:

an inclined plane cooperating with an edge of a portion of the radial extension associated with the locking device to make the lever swivel during the moving of the disc under the action of the elastic member;

a flat part acting as an abutment against a portion of said radial extension in order to lock the disc in a position remote from the bottom of the socket;

said lever being further movable in a direction essentially radial relative to the longitudinal axis of the socket under the action of an actuating member disposed at an exterior of the socket and adapted cause the lever to slide along the radial extension until the lever faces an indentation or an extremity of said radial extension, thus releasing the disc.

9. A socket according to claim 6, wherein the locking device includes an automatic release controlled during the fitting of a light bulb into the socket.

10. A socket according to claim 9, wherein said locking device comprises:

at least a lever movable in a direction essentially radial relative to the longitudinal axis of the socket under the action of an actuating member arranged inside the socket, to have the lever slide along the radial extension until the faces an indentation or an extremity of said radial extension, thus releasing the disc.

11. A socket according to claim 1, further comprising a safety device adapted to detect a presence or the absence of the glass of a light bulb on said socket and to cut-off at least the electric circuit connecting the first contact piece and the first contact block when the safety device has detected the absence of said light bulb glass.

12. Socket according to claim 11, wherein said safety device includes at least a pushbutton adapted to slide parallel to the longitudinal axis of the socket into a recess of the insulating support, an elastic member adapted to push a first extremity of said pushbutton outside of said socket to detect a presence or absence of said glass, the other extremity of said pushbutton being provided with a first contact member cooperating with a fixed second contact member, said second contact member closing the supply circuit of the first block from said first contact piece when said first extremity of the pushbutton has detected the presence of a glass on the socket and opening said supply circuit when said first extremity of the pushbutton has detected the absence of a glass on the socket.

13. A socket according to claim 12, further comprising a plurality of said pushbuttons distributed on an outer periphery of the socket, said contact members of each of said pushbuttons being mounted in series with said first contact piece and said first contact block.

14. A socket according to claim 1, further comprising a housing for a micro-fuse provided in a supply circuit of the first contact block.

15. A socket according to claim 1, wherein the first contact piece corresponds to a contact terminal adapted to receive a first electric supply wire and the second contact piece corresponds to a contact terminal adapted to receive a second electric supply wire.

16. A socket according to claim 1, wherein the socket is provided as a transition socket comprising:

an external conductive tube and an external cap bottom contact;

an internal conductive tube; and at least a first contact block, the first contact piece corresponding to said cap bottom contact while the second contact piece corresponds to said external conductive tube.

17. A socket according to claim 16, wherein at least one of the external or internal conductive tubes is a threaded conductive tube.

18. A socket according to claim 16, wherein at least one of the external or internal conductive tubes corresponds to a bayonet cap.

19. A socket according to claim 16, further comprising a locking member adapted to lock the transition socket mounted on another socket.

20. A socket for an electric light bulb comprising:

a first electric supply circuit supplying a phase voltage and including at least a first contact block provided at a bottom of the socket and a first contact piece;

a second electric supply circuit supplying a neutral voltage and including at least a fixing tube having at least one conductive portion fitted into an insulating support and a second contact piece;

a safety device adapted to detect a presence or absence of a light bulb in said socket, the safety device including a disc made of an insulating material and provided with a plurality of radial extensions;

said disc being fitted into said socket so that the plan of said disc is essentially perpendicular to the longitudinal axis of the socket, said disc being adapted to slide in a direction of said longitudinal axis of the socket, being pushed by an elastic member to move away from the bottom of the socket, said radial extensions being adapted to slide into recesses provided within the socket in order to guide said disc, an abutment being provided into at least one recess to restrict the sliding of the disc towards the exterior of the socket; and said disc further comprising at least one conductive capsule traversing the disc and adapted to establish an electric contact between the first contact block and a cap bottom contact of the light bulb when the disc is pushed against the bottom of the socket by said light bulb fitted into the socket;

wherein the socket further includes:

an additional safety device including an insulated actuating device having a first extremity protruding in the interior of the socket and a second extremity provided within a recess of the insulating support and provided with a first contact capsule;

a second contact capsule being disposed into said recess opposite said first contact capsule;

an elastic member being provided to separate the contact capsules one from the other;

the fitting of a cap of a light bulb into the socket actuating said insulated actuating means, thus putting into contact the two said contact capsules, a first of said capsules being electrically connected to the conductive portion of the support tube while the second of said capsules being electrically connected to the second contact piece.

21. A socket according claim 20, wherein the first contact block is electrically connected to the first contact piece.

22. A socket according to claim 20, further comprising at least one locking device adapted to lock said disc in a position remote from the bottom of the socket.

23. A socket according to claim 22, wherein the locking device includes a manual release.

24. A socket according to claim 23, wherein said locking device comprises a lever swivellingly mounted on a pivot essentially perpendicular to the longitudinal axis of the socket, said lever including:

an inclined plane cooperating with an edge of a portion of the radial extension associated with the locking device to make the lever swivel during the moving of the disc under the action of the elastic member;

a flat part acting as an abutment against a portion of said radial extension in order to lock the disc in a position remote from the bottom of the socket;

said lever being further movable in a direction essentially radial relative to the longitudinal axis of the socket under the action of an actuating member disposed at an exterior of the socket and adapted cause the lever to slide along the radial extension until the lever faces an indentation or an extremity of said radial extension, thus releasing the disc.

25. A socket according to claim 22, wherein the locking device includes an automatic release controlled during the fitting of a light bulb into the socket.

26. A socket according to claim 25, wherein said locking device comprises:

at least a lever movable in a direction essentially radial relative to the longitudinal axis of the socket under the action of an actuating member arranged inside the socket, to have the lever slide along the radial extension until the faces an indentation or an extremity of said radial extension, thus releasing the disc.

27. A socket according to claim 20, further comprising a safety device adapted to detect a presence or the absence of the glass of a light bulb on said socket and to cut-off at least the electric circuit connecting the first contact piece and the first contact block when the safety device has detected the absence of said light bulb glass.

28. A socket according to claim 27, wherein said safety device includes at least a pushbutton adapted to slide parallel to the longitudinal axis of the socket into a recess of the insulating support, an elastic member adapted to push a first extremity of said pushbutton outside of said socket to detect a presence or absence of said glass, the other extremity of said pushbutton being provided with a first contact member cooperating with a fixed second contact member, said second contact member closing the supply circuit of the first block from said first contact piece when said first extremity of the pushbutton has detected the presence of a glass on the socket and opening said supply circuit when said first extremity of the pushbutton has detected the absence of a glass on the socket.

29. A socket according to claim 28, further comprising a plurality of said pushbuttons distributed on an outer periphery of the socket, said contact members of each of said pushbuttons being mounted in series with said first contact piece and said first contact block.

30. A socket according to claim 20, further comprising a housing for a micro-fuse provided in a supply circuit of the first contact block.

31. A socket according to claim 20, wherein the first contact piece corresponds to a contact terminal adapted to receive a first electric supply wire and the second contact piece corresponds to a contact terminal adapted to receive a second electric supply wire.

32. A socket according to claim 20, wherein the socket is provided as a transition socket comprising:

an external conductive tube and an external cap bottom contact;

an internal conductive tube; and at least a first contact block, the first contact piece corresponding to said cap bottom contact while the second contact piece corresponds to said external conductive tube.

33. A socket according to claim 32, wherein at least one of the external or internal conductive tubes is a threaded conductive tube.

34. A socket according to claim 32, wherein at least one of the external or internal conductive tubes corresponds to a bayonet cap.

35. A socket according to claim 32, further comprising a locking member adapted to lock the transition socket mounted on another socket.

* * * * *

UNITED STATES PATENT AND TRADEMARK OFFICE

CERTIFICATE OF CORRECTION

PATENT NO. : 6,491,534 B1
DATED : December 10, 2002
INVENTOR(S) : Yves Bonard et al.

It is certified that error appears in the above-identified patent and that said Letters Patent is hereby corrected as shown below:

Column 2,
Line 2, “fine” should be -- line --.

Column 4,
Line 41, “out-off” should be -- cut-off --.
Line 59, delete “one”.

Column 6,
Lines 39-40, “block” should be -- blocks --.

Column 7,
Line 55, “rover” should be -- lever --.

Column 9,
Line 18, “as” should be -- a --.

Column 10,
Line 64, after “cause” insert -- to --.

Column 11,
Line 10, after “the” insert -- lever --.
Line 18, “Socket” should be -- A socket --.

Column 12,
Line 64, after “adapted” insert -- to --.

UNITED STATES PATENT AND TRADEMARK OFFICE

CERTIFICATE OF CORRECTION

PATENT NO. : 6,491,534 B1 
DATED : December 10, 2002
INVENTOR(S) : Yves Bonard et al.

It is certified that error appears in the above-identified patent and that said Letters Patent is hereby corrected as shown below:

Column 13,
Line 10, after "the" insert -- lever --.

Signed and Sealed this

Second Day of September, 2003

JAMES E. ROGAN
*Director of the United States Patent and Trademark Office*